US008021211B2

(12) United States Patent
Chen et al.

(10) Patent No.: US 8,021,211 B2
(45) Date of Patent: Sep. 20, 2011

(54) SUBSTRATE HOLDER WITH LIQUID SUPPORTING SURFACE

(75) Inventors: Hung Chih Chen, Sunnyvale, CA (US); Yin Yuan, Sunnyvale, CA (US); Stephen Jew, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 702 days.

(21) Appl. No.: 12/105,798

(22) Filed: Apr. 18, 2008

(65) Prior Publication Data

US 2009/0264056 A1 Oct. 22, 2009

(51) Int. Cl.
*B24B 7/22* (2006.01)

(52) U.S. Cl. ..... 451/41; 451/289; 451/411

(58) Field of Classification Search ..... 451/411, 451/412, 413, 287, 288, 289, 41, 406, 5
See application file for complete search history.

(56) References Cited

U.S. PATENT DOCUMENTS

| | | | | |
|---|---|---|---|---|
| 4,373,991 | A * | 2/1983 | Banks | 451/28 |
| 4,625,463 | A * | 12/1986 | Sekiya | 451/54 |
| 5,186,238 | A | 2/1993 | del Puerto et al. | |
| 5,762,539 | A * | 6/1998 | Nakashiba et al. | 451/41 |
| 6,276,998 | B1 * | 8/2001 | Sommer et al. | 451/41 |
| 6,296,555 | B1 * | 10/2001 | Inaba et al. | 451/282 |
| 6,623,329 | B1 * | 9/2003 | Moore | 451/5 |
| 6,897,124 | B2 | 5/2005 | Tate et al. | |
| 7,044,832 | B2 | 5/2006 | Yilmaz et al. | |
| 2003/0192577 | A1 | 10/2003 | Thakur et al. | |
| 2006/0238954 | A1 | 10/2006 | Ishikawa et al. | |

* cited by examiner

*Primary Examiner* — Robert Rose
(74) *Attorney, Agent, or Firm* — Patterson & Sheridan, L.L.P.

(57) ABSTRACT

Embodiments of the present invention generally relate to a substrate transferring system. One embodiment of the present invention provides a substrate holder comprising a pedestal plate, a basin wall extending from a top surface of the pedestal plate, wherein the basin wall has a substantially leveled top surface, the basin wall and the pedestal plate define a basin configured to retain a liquid therein, and a liquid port opening to the basin, wherein the liquid port is configured to flow a liquid to the basin and allow the liquid to overflow from the basin wall, and a top surface of the overflow liquid in the basin is configured to support a substrate without contacting the basin wall or the pedestal plate.

15 Claims, 12 Drawing Sheets

SUBSTRATE HOLDER WITH LIQUID SUPPORTING SURFACE

BACKGROUND OF THE INVENTION

1. Field of the Invention

Embodiments of the present invention generally relate to an apparatus and a method for transferring a substrate during processing. More particularly, embodiments of the present invention provide apparatus and method for supporting a substrate during loading and unloading.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features.

Planarization is generally performed using Chemical Mechanical Polishing (CMP) and/or Electro-Chemical Mechanical Deposition (ECMP). A planarization method typically requires that a substrate be mounted in a carrier head, with the surface to be polished exposed. The substrate supported by the carrier head is then placed against a rotating polishing pad. The carrier head holding the substrate may also rotate, to provide additional motion between the substrate and the polishing pad surface. A polishing solution is usually supplied to the rotating polishing surface to assist the planarization process.

During the planarization process, the substrate is generally secured on the carrier head from the backside of the substrate, for example by forming vacuum cups between a membrane on the carrier head and the backside of the substrate. Prior to or after the planarization process, a load cup is generally used for substrate transferring to and from a carrier head.

In the state of the art load cup may have a substrate supporting means, for example, support fingers, configured to hold a substrate and transfer the substrate to and from the carrier head. When unloading a substrate from a carrier head, the membrane is usually inflated to release the vacuum cups between the membrane and the backside of the substrate. The substrate will then fall off the carrier head to a load cup underneath under the effect of gravity. FIG. 1 schematically illustrates a substrate holder used in the state of the art load cup. A carrier head 10 having a membrane 11 configured to secure a substrate 12 thereon. The membrane 11 is inflated so that the substrate 12 is no longer drawn to the carrier head 10 by suction. A substrate holder 15 having a plurality of support fingers 14 is positioned underneath the carrier head 10 to catch the substrate 12 once the substrate 12 falls off the carrier head 10 under the effect of gravity. During this transferring process, a processed surface 13 of the substrate 12 is exposed to air or other process environment. The processed surface 13 is generally wet from polishing solutions on polishing stations. Structures, such as copper structures, easily corroded when exposing to air in a wet condition.

The state of the art load cup has several limitations. First, the time requires to load/unload a substrate from a carrier head is relatively long and unpredictable since the load cup passively waits for gravity to take effect. Second, a substrate to be loaded/unloaded is generally wet and exposed to atmosphere during unloading resulting in corrosion on the processed surface.

Therefore, there is a need for apparatus and method to transfer a substrate at an increased and predictable rate and with decreased corrosion.

SUMMARY OF THE INVENTION

The present invention generally relates to a substrate transferring system. Particularly, the present invention relates to a load cup for transferring a substrate with reduced corrosion and increased speed.

One embodiment of the present invention provides a substrate holder comprising a pedestal plate, a basin wall extending from a top surface of the pedestal plate, wherein the basin wall has a substantially leveled top surface, the basin wall and the pedestal plate define a basin configured to retain a liquid therein, and a liquid port opening to the basin, wherein the liquid port is configured to flow a liquid to the basin and allow the liquid to overflow from the basin wall, and a top surface of the overflow liquid in the basin is configured to support a substrate without contacting the basin wall or the pedestal plate.

Another embodiment of the present invention provides a method for transferring a substrate comprising holding the substrate using a first substrate holder, filling a basin in a second substrate holder with a liquid to form a liquid surface over a basin wall of the second substrate holder, maintaining a flow of the liquid to the basin to allow the liquid overflow from the basin wall without disturbing the liquid surface, and releasing the substrate from the first substrate holder to the liquid surface, wherein the substrate is supported on the liquid surface.

Yet another embodiment of the present invention relates to a method for transferring a substrate comprising maintaining a flow of the liquid to a basin of a load cup to form a liquid support surface for supporting a substrate and to allow the liquid overflow from walls of the basin without disturbing the liquid support surface, aligning a first substrate handler with the load cup, wherein the substrate is secured by the first substrate handler, releasing the substrate to the load cup, wherein the substrate is supported by the liquid support surface, aligning a second substrate handler with the load cup, loading the substrate to the second substrate handler, and draining the liquid from the basin of the load cup.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The present invention generally relates to an apparatus and a method for transferring a substrate, particularly relates to supporting a substrate in a chemical mechanical polishing (CMP) system or electrochemical mechanical polishing (ECMP) system.

Figure 1:
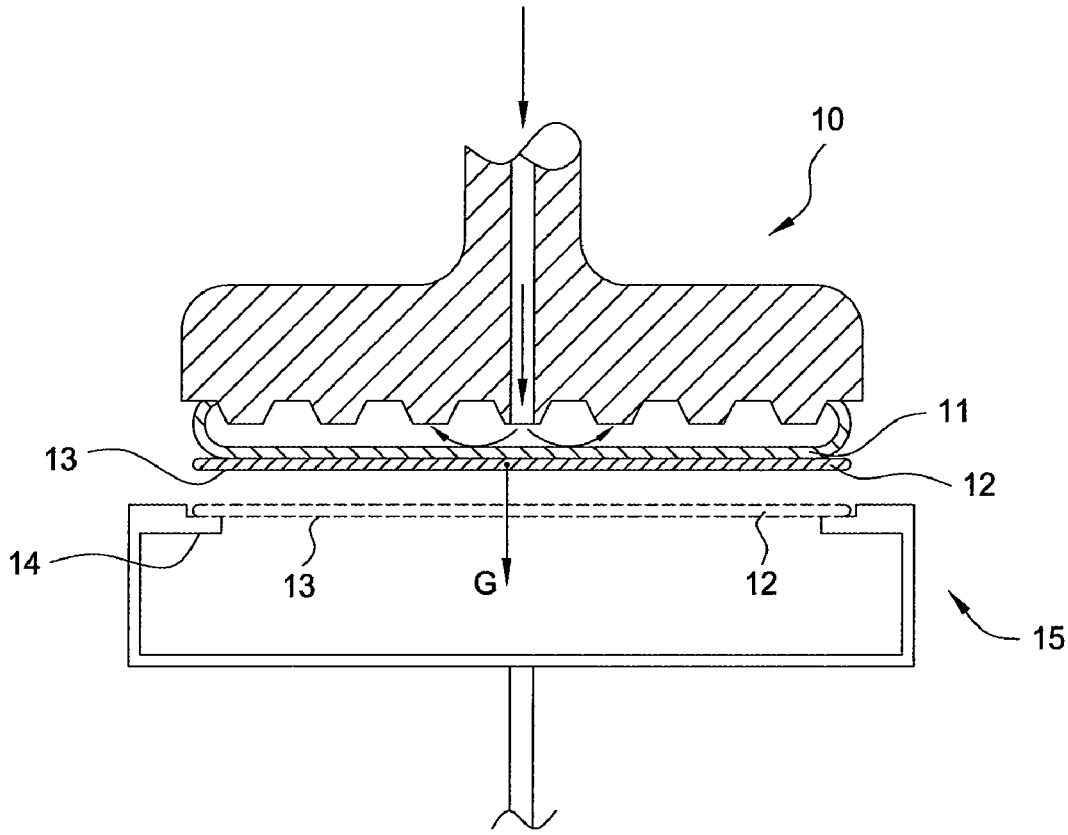
FIG. 1 (PRIOR ART)
FIG. 1 (prior art) schematically illustrates a substrate holder used in the state of the art load cup.
Figure 2:
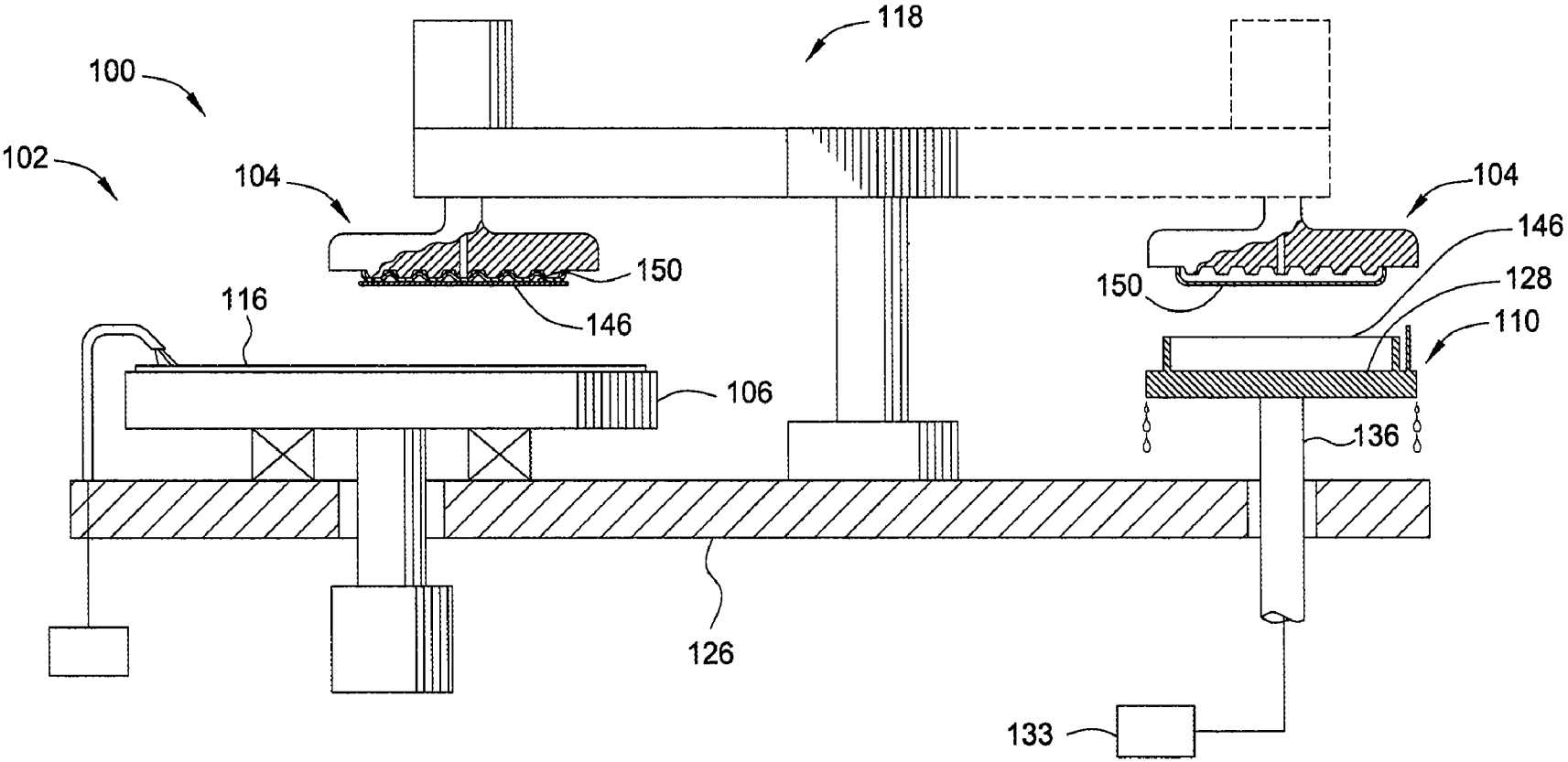
FIG. 2 schematically illustrates a planarization system in accordance with one embodiment of the present invention.

FIG. 2 illustrates a partial sectional view of a polishing system 100. The polishing system 100 comprises a polishing station 102, a carrier head 104 and a load cup 110. The polishing station 102 comprises a rotatable platen 106 having a polishing material 116 disposed thereon. The carrier head 104 is supported above the polishing station 102 coupled to a base 126 by a transfer mechanism 118.

The transfer mechanism 118 is adapted to position the carrier head 104 selectively over the polishing material 116 or over the load cup 110 (shown in dotted lines). The carrier head 104 comprises a membrane 150 configured to hold a substrate 146 thereon. A detailed description of the carrier head 104 may be found in U.S. Pat. No. 6,183,354, entitled "Carrier Head with a Flexible Membrane for a Chemical Mechanical Polishing", and U.S. patent application Ser. No. 11/054,128 filed on Feb. 8, 2005 now U.S. Pat. No. 7,001,257, entitled "Multi-chamber Carrier Head with a Flexible Membrane", which are herein incorporated as reference.

The load cup 110 generally includes a pedestal assembly 128 configured to support a substrate 146 on a liquid surface. The pedestal assembly 128 is supported by a shaft 136 which is coupled to an actuator 133. When transferring a substrate between the load cup 110 and the carrier head 104, the carrier head 104 is generally rotated to above the load cup 110, as shown in the dotted lines. The membrane 150 may be inflated to release the substrate 150 which is then grabbed by the load cup 110.

In one embodiment, the pedestal assembly 128 defines a shallow basin configured to retain liquid, such as deionized (DI) water, and to support the substrate 146 on a top surface of the retained liquid in the shallow basin.

Figure 3:
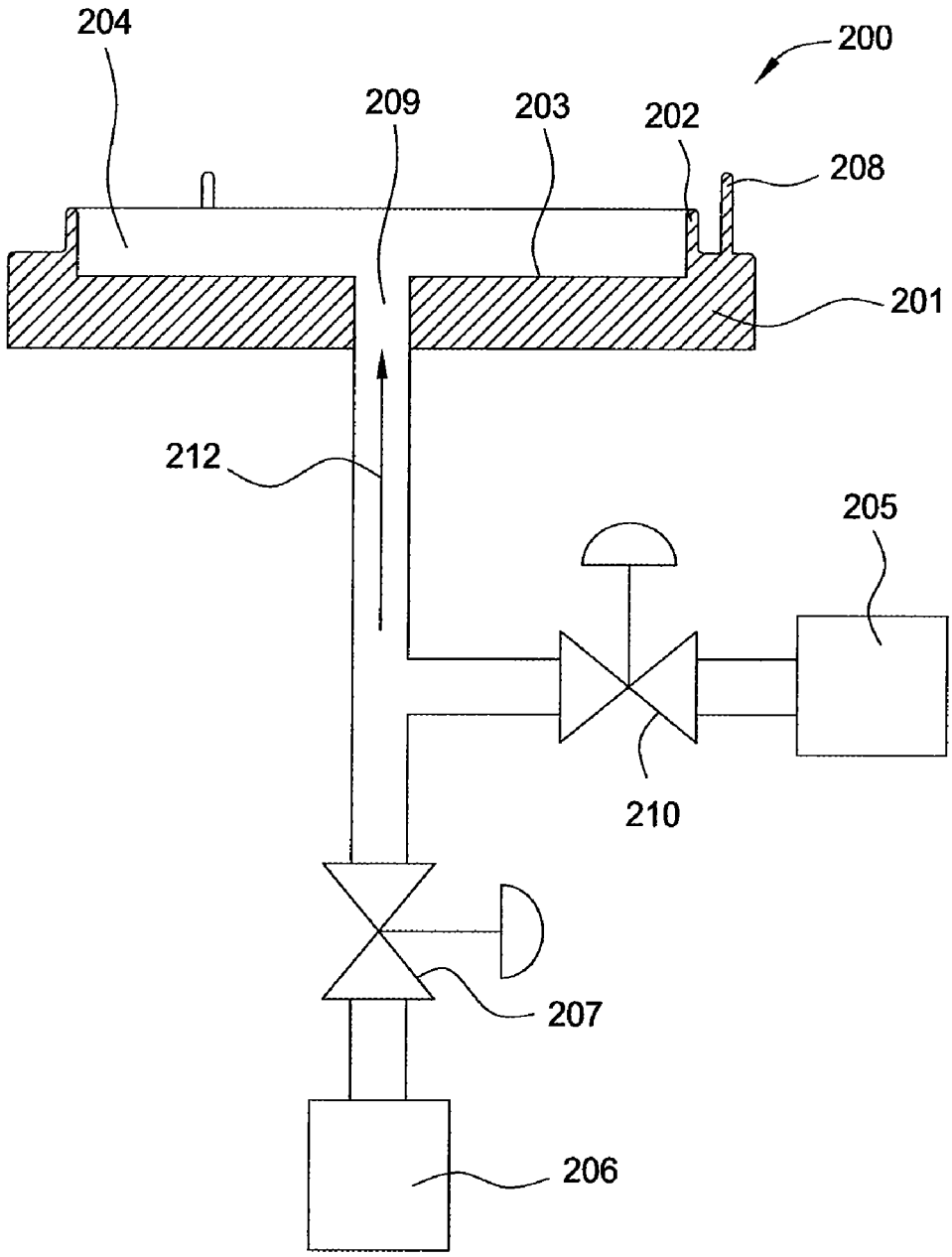
FIG. 3 schematically illustrates a substrate holder in accordance with one embodiment of the present invention.

FIG. 3 schematically illustrates a non-contact substrate holder 200 in accordance with one embodiment of the present invention. The non-contact substrate holder 200 is configured to support a substrate on a liquid support surface formed in a basin, wherein the substrate does not contact the non-contact substrate holder 200 other than the liquid support surface. The non-contact substrate holder 200 may be used as the pedestal assembly 128 of the polishing system 100 of FIG. 2.

The non-contact substrate holder 200 comprises a pedestal 201 having a basin wall 202 extended thereon. The basin wall 202 and an inner surface 203 of the pedestal 201 form a basin 204. The basin 204 is configured to retain a liquid and form a liquid support surface to support a substrate thereon.

A liquid port 209 is formed on the pedestal 201 near a center of the inner surface 203. The liquid port 209 is in fluid communication with a liquid source 205 and is configured to fill the basin 204 and to provide a liquid flow to the basin 204 during operation. After the basin 204 has been filled, a liquid flow from the liquid port 209 will cause the liquid to over flow out of the basin wall 202. The liquid flow is configured to provide a force to the liquid support surface for supporting a substrate thereon without disturbing the liquid support surface.

In one embodiment, the liquid port 209 is also connected to a collecting pen 206 to which liquid in the basin 204 may be drained. Shut off valves 207, 210 may be used to switch the basin 204 between the liquid source 205 and the collecting pen 206. In another embodiment, an output port may be formed on the pedestal 201 to drain the basin 202.

The non-contact substrate holder 200 is configured to support a substrate on a liquid support surface over the basin 201. The basin 201 may have a surface area smaller than a substrate. In one embodiment, at least three blocking pins 208 may extend from the pedestal 201 outside the basin wall 202. The blocking pins 208 are higher than the basin wall 202 and are configured to keep a substrate supported on the liquid support surface from drifting away.

FIGS. 4A-4E schematically illustrate substrate unloading/loading process in accordance with one embodiment of the present invention using the non-contact substrate holder 200 of FIG. 3.

Figure 4A:
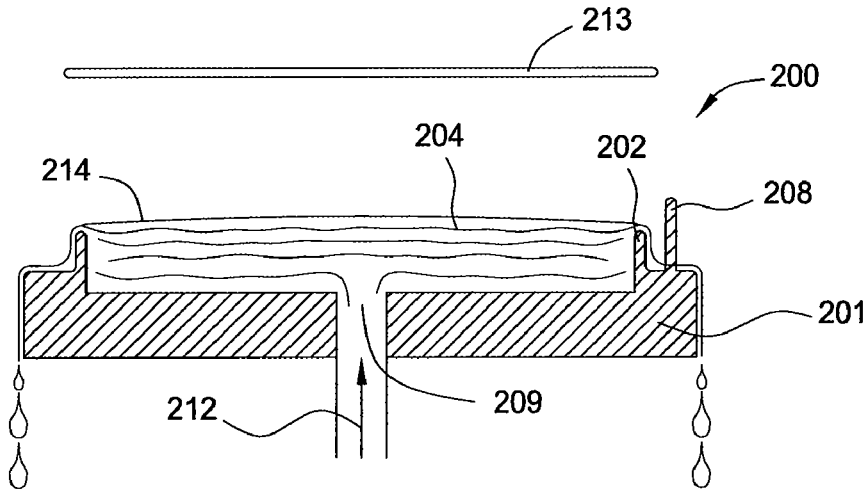
FIGS. 4A-4F schematically illustrate substrate unloading/loading process in accordance with one embodiment of the present invention.

FIG. 4A schematically illustrates the non-contact substrate holder 200 in a receiving state. A liquid flow 212 is provided continuously to the basin 204 through the liquid port 209 forming a liquid support surface 214 and causing liquid to over flow over the basin wall 202. Flow rate of the liquid flow 212 is set such that the force of over flowing liquid is large enough to support a substrate over the liquid support surface 214 without generating disturbance, such as bubbles, on the liquid support surface 214.

Figure 4B:
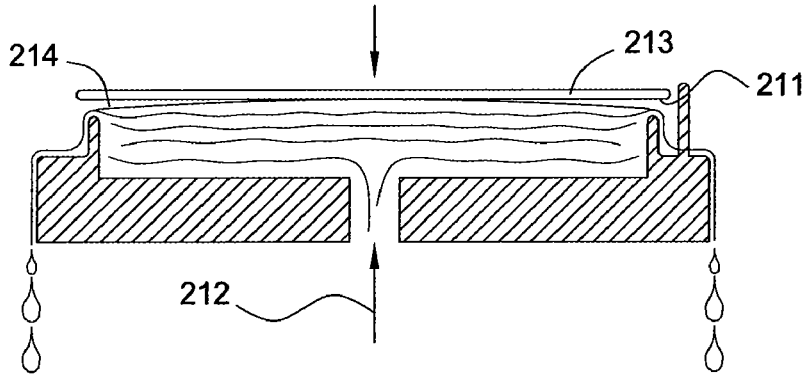

As shown in FIG. 4B, a substrate 213 may be lowered towards the liquid support surface 214 to be loaded on the non-contact substrate holder 200. The substrate 213 may be lowered to the liquid support surface 214 by any a substrate handler, such as a robot or a polishing head. The liquid support surface 214 may have a slightly domed shape due to the liquid flow 212 entering near a center of the basin 202. As a result of the domed shape of the liquid support surface 214, center areas of a surface 211 of the substrate 213 usually contacts the liquid support surface 214 first. As the substrate 213 continue to lower, contact areas between the surface 211 the liquid support surface 214 gradually increase from center outwards to a complete contact.

Figure 4C:
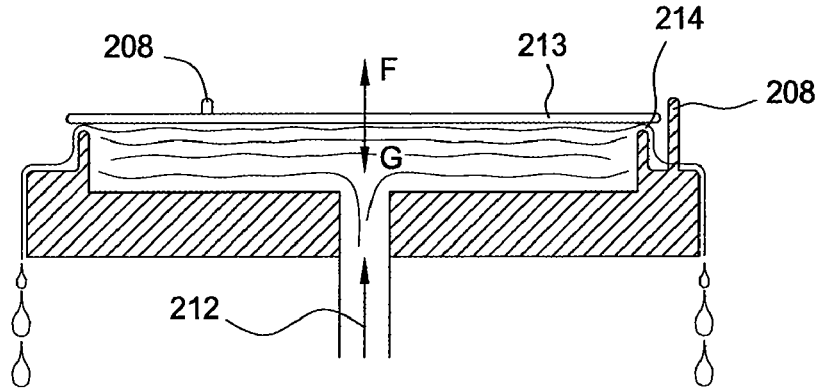

As shown in FIG. 4C, the substrate 213 is held by the non-contact substrate holder 200 over the liquid support surface 214. Gravity G of the substrate 213 is countered by upward force F from upward liquid flow 212 and surface tension of the liquid support surface 214. In one embodiment, the liquid is DI water. In one embodiment, the liquid flow has a flow rate of about 2 liter/minute to about 6 liter/minute for supporting a substrate on the liquid support surface 214.

The substrate 213 may be held in FIG. 4C waiting to be transferred to another substrate handler, for example a robot or a polishing head. A substrate handler, which secures a substrate by an edge of the substrate, may grab the substrate 213 by edge while the substrate 213 is supported by the liquid support surface 214. Once, the substrate handler has a secure handle of the substrate 213, the liquid flow 212 may be stopped and basin 202 drained for the substrate 213 to be lifted away.

Figure 4D:
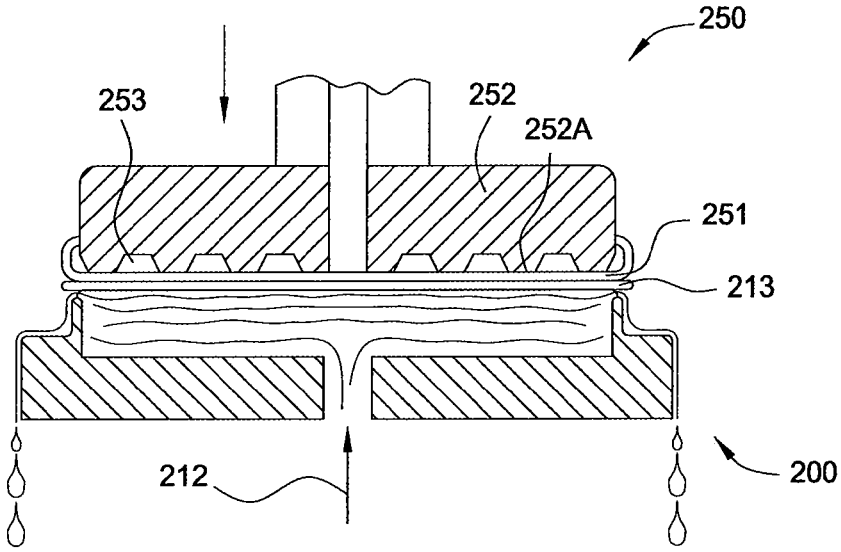
Figure 4E:
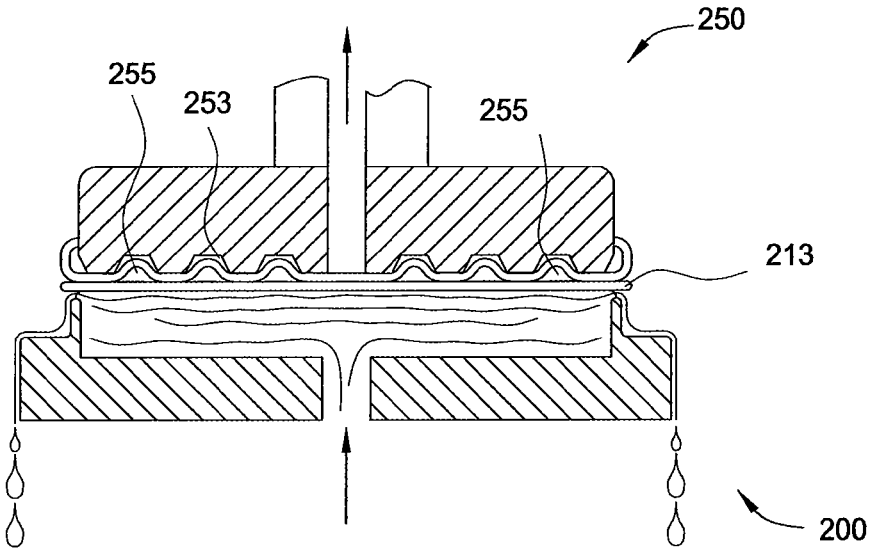

Polishing heads used in chemical mechanical polishing generally hold substrates from backside by vacuum. FIGS. 4D-4E schematically illustrate transferring of the substrate 213 from the non-contact substrate holder 200 to a polishing head 250.

The polishing head 250 comprises a support plate 252 surrounded by a membrane 251 configured to be in contact with a backside of a substrate. The support plate 252 has a planar surface 252*a* and a plurality of recesses 253 are formed on the support plate 252. A pumping system is generally connected to the space between the support plate 252 and the membrane 251 to inflate and deflate the membrane 251. To load a substrate, the support plate 252 may be used to push the membrane 251 against a backside of the substrate. The membrane 251 is then deflated generating vacuum pouches between the membrane 251 and the substrate when portions of the membrane 251 retreat into the plurality of recesses 253 formed on the support plate 252.

A detailed description of similar polishing head and method for loading/unloading substrates using such polishing head may be found in the U.S. patent application Ser. No. 11/757,069, filed Jun. 1, 2007, entitled "Fast Substrate Loading on Polishing Head without Membrane Inflation Step", which is incorporated by reference.

As shown in FIG. 4D, the polishing head 250 approaches the non-contact substrate holder 200 and presses the membrane 251 against the substrate 213 supported on the liquid support surface 214. The pressing allows the membrane 251 to make solid contact with the substrate 213. The pressing force of the polishing head 250 and gravity of the substrate 213 is countered by upward force F from upward liquid flow 212 and surface tension of the liquid support surface 214.

In one embodiment, the flow rate of the liquid flow 212 may be increased to support the substrate 213 while the polishing head 250 presses against the substrate 250. In one embodiment, the liquid flow has a flow rate of about 2 liter/minute to about 6 liter/minute during pressing of the polishing head 250.

As shown in FIG. 4E, after the membrane 251 makes full contact with the substrate 213, the membrane 251 is then deflated to form a plurality of vacuum pouches 255 between the substrate 213 and the membrane 251 within the plurality of recesses 253. The substrate 213 is now secured to the polishing head 250.

Figure 4F:
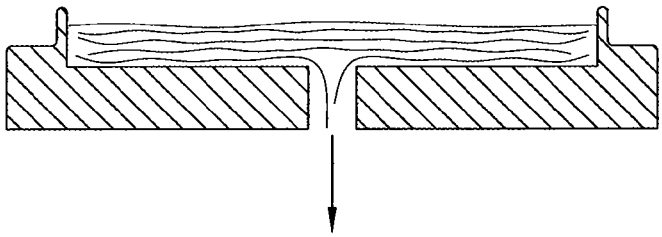

Once the substrate 213 is secured attached to the polishing head 250, the liquid flow 212 may be stopped and basin 202 drained for the substrate 213 to be transferred to the polishing head 250, as shown in FIG. 4F. In another embodiment, the liquid flow 212 may be increased to push the substrate 213 towards the polishing head 250.

Figure 5:
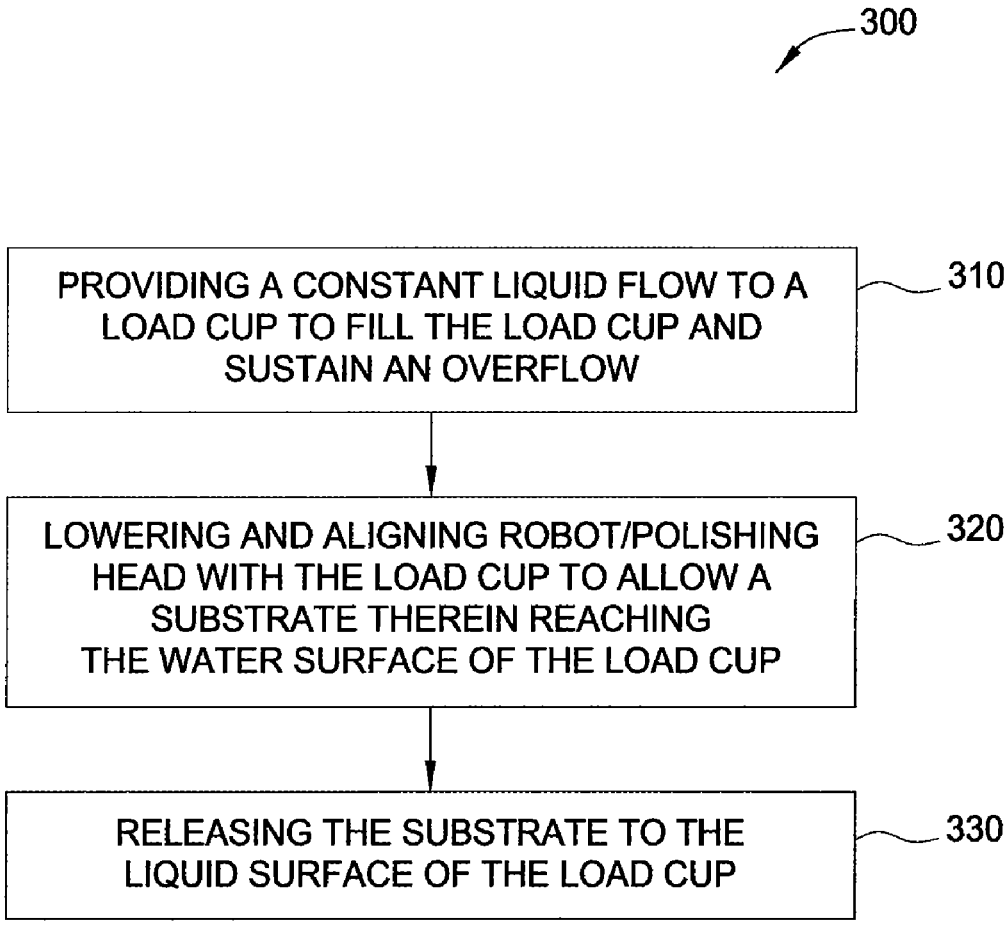
FIG. 5 is a flow chart showing a substrate loading method in accordance with one embodiment of the present invention.

FIG. 5 is a flow chart showing a method 300 for loading a substrate to a load cup in accordance with one embodiment of the present invention.

In step 310, a liquid flow is provided to a load cup having a basin to fill the basin and maintain an overflow from the basin. The liquid flow is configured to form a liquid surface over the basin for supporting a substrate thereon. In one embodiment, the liquid flow may have a constant flow rate.

In step 320, a substrate is lowered toward the liquid support surface by a substrate handler, such as a robot or a polishing head.

In step 330, the substrate is released from the substrate handler to the load cup on the liquid support surface. The liquid flow allows the substrate stay afloat on the liquid support surface.

Figure 6:
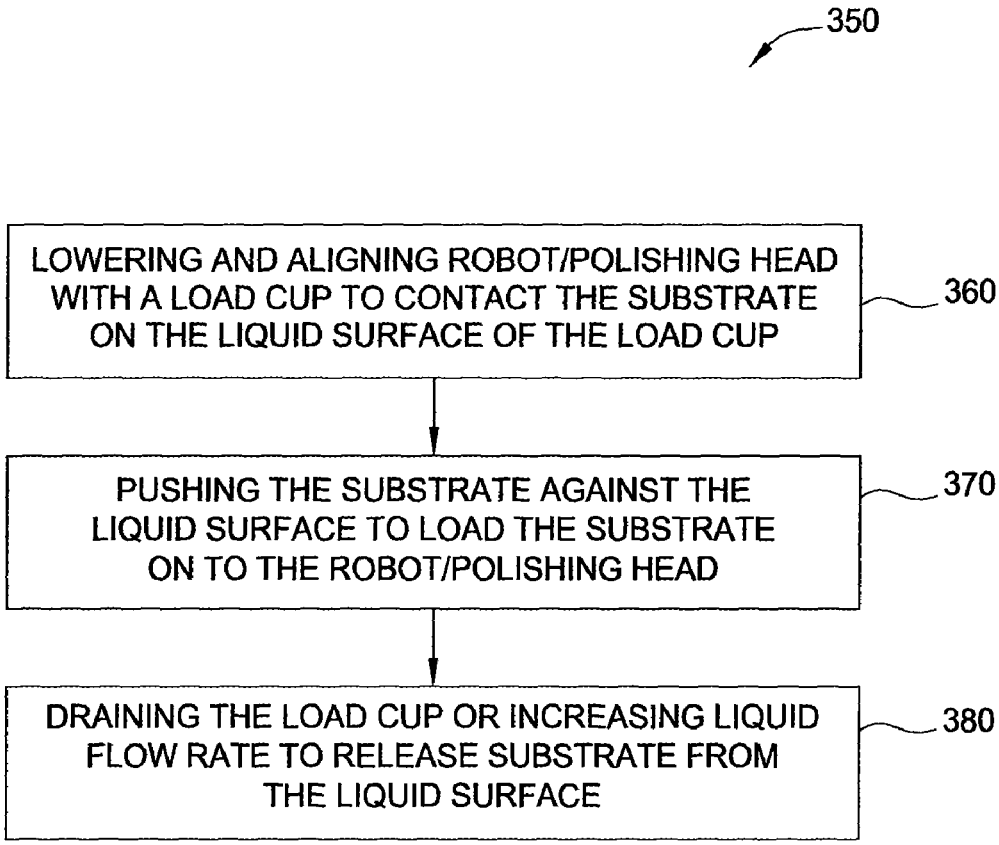
FIG. 6 is a flow chart showing a substrate unloading method in accordance with one embodiment of the present invention.

FIG. 6 is a flow chart showing a method 350 for unloading a substrate from a load cup in accordance with one embodiment of the present invention.

In step 360, a substrate holder, such as a robot or a polishing head, is aligned with a substrate supported on a liquid surface of a load cup. The alignment may be completed using alignment pins disposed on the load cup.

In step 370, the substrate holder pushes the substrate against the liquid support surface to load the substrate on the substrate holder.

In step 380, the load cup is drained or the liquid flow rate is increased to release the substrate from the liquid surface of the load cup.

Figure 7A:
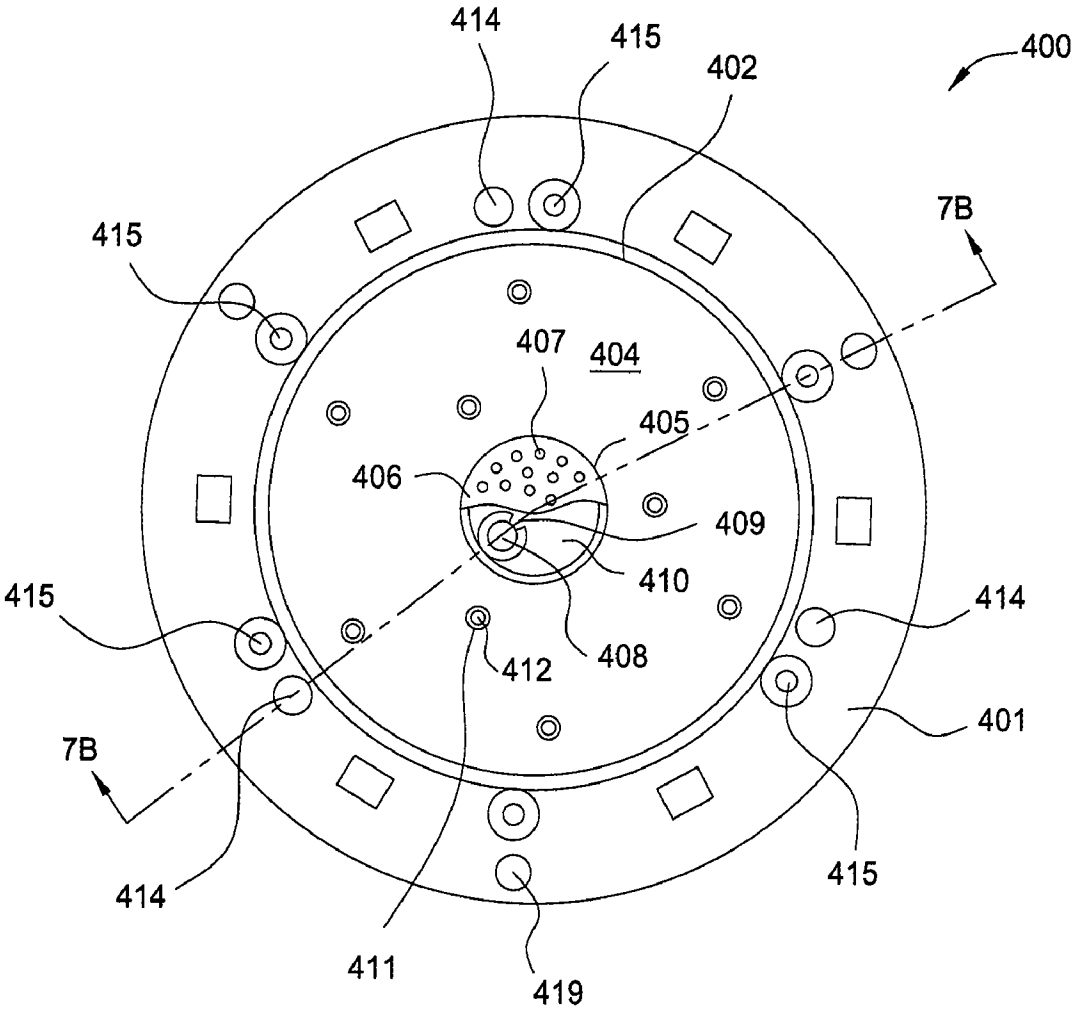
FIGS. 7A-7E schematically illustrate a substrate holder in accordance with one embodiment of the present invention.
Figure 7B:
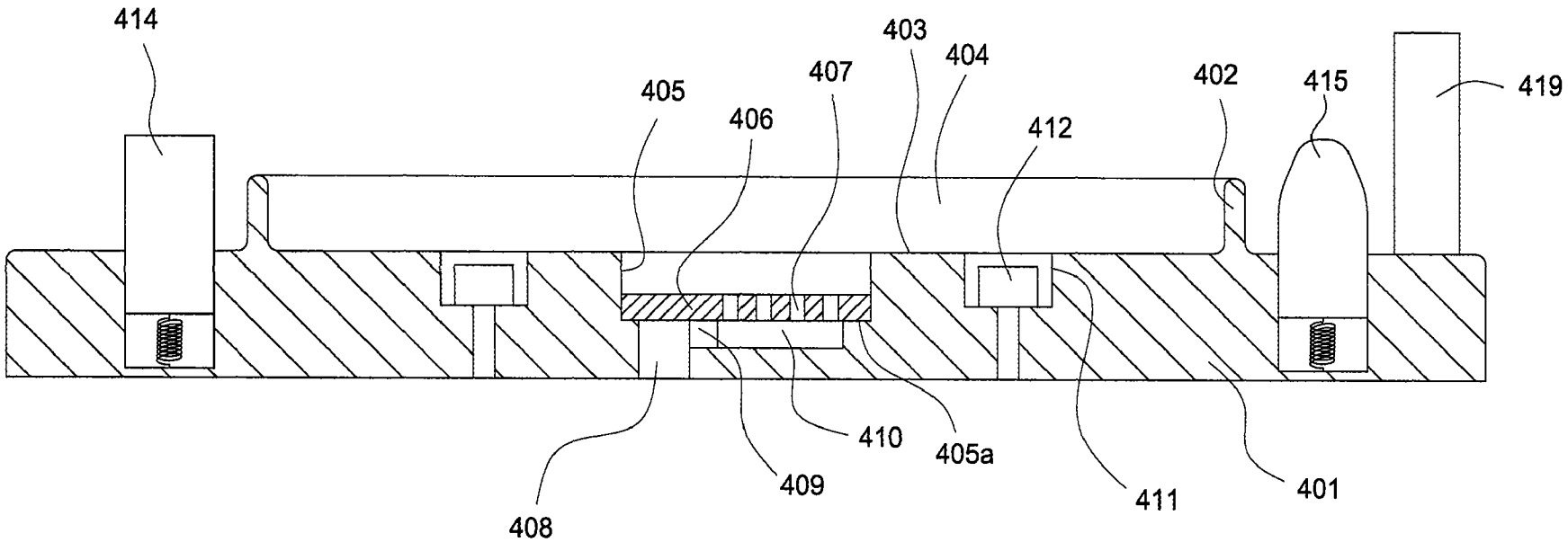

FIGS. 7A-7E schematically illustrate a substrate holder 400 in accordance with one embodiment of the present invention. FIG. 7A is a schematic top view of the substrate holder 400 and FIG. 7B is a schematic side view of the substrate holder 400.

The substrate holder 400 comprises a pedestal body 401. A basin wall 402 extends from the pedestal body 401. The basin wall 402 and a top surface 403 of the pedestal body 401 form a basin 404. In one embodiment, the basin 404 is substantially circular and configured to support a circular substrate.

A liquid port 405 is formed on the pedestal body 401 near a center of the basin 404. A port 408 is formed within the liquid port 405. The port 408 may be adapted to a liquid source or a drain. The port 408 is substantially smaller in diameter than the recess and has a side opening 409 opens to a buffering basin 410. The liquid port 405 has a shoulder 405*a* configured to support a cover 406 thereon. The cover 406 has a plurality of openings 407 between the buffering basin 410 and the basin 404.

Figure 7C:
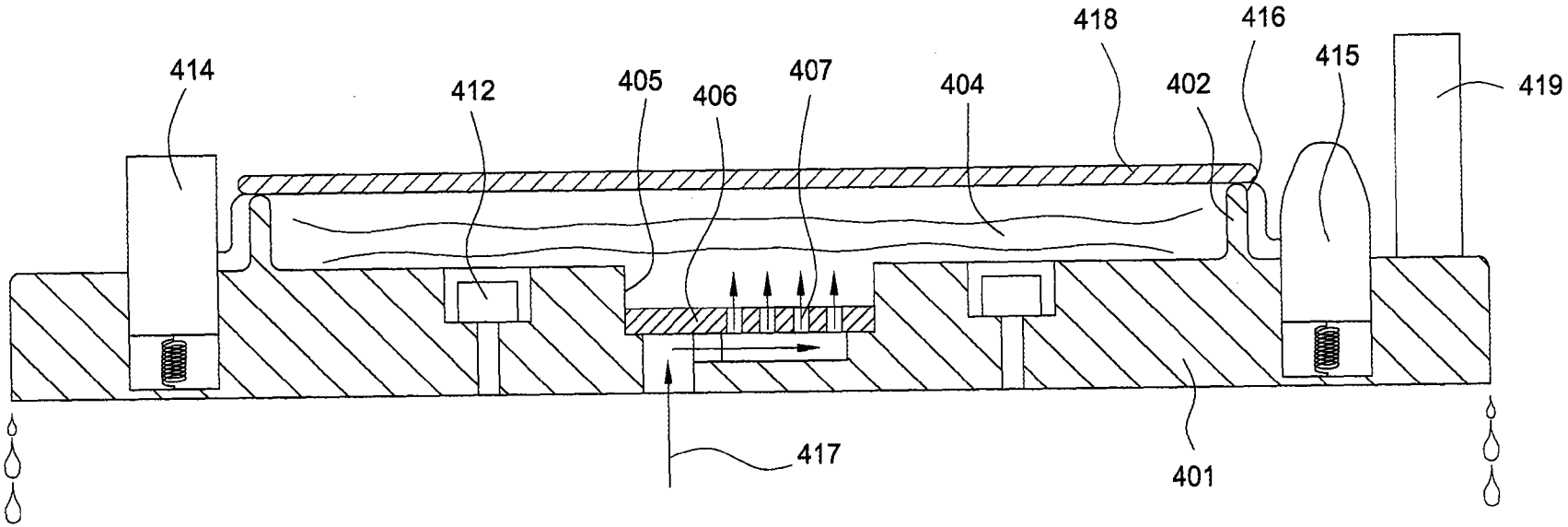

FIG. 7C schematically illustrates the substrate holder 400 supporting a substrate 418 thereon. A liquid flow 417 enters of the port 408 maintains an overflow off the basin wall 402 allowing the substrate 418 to be supported on a liquid surface 416 within the basin 404.

The cover 406 covers the port 408 directing flow of a liquid along a path from the port 408 through the side opening 409 to the buffering basin 410, then through the plurality of openings 407 to the basin 404, as shown in FIG. 7C. This configuration reduces turbulence to a liquid surface 416 from the incoming liquid flow 417 from the port 408 to achieve a smooth liquid surface 416. The smooth liquid surface of the present invention reduces air bubbles between the liquid surface 416 and the substrate supported thereon, thus reduces corrosion. The smooth liquid surface all so reduces damages to structures on the substrate from the liquid flow. During draining, the liquid flows a reversed direction as shown in FIG. 7C.

Figure 7D:
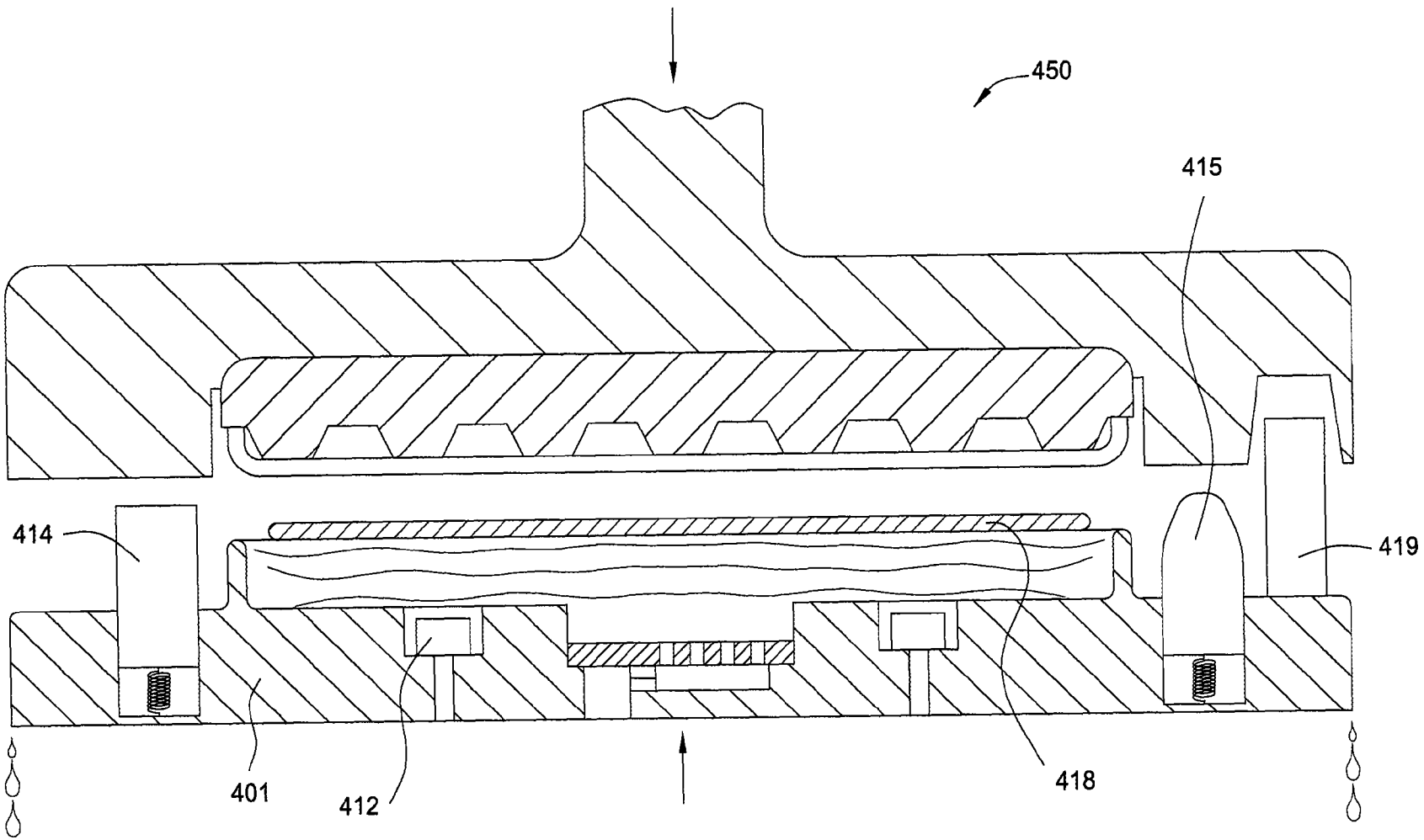

Returning to FIGS. 7A-7B, the substrate holder 400 further comprises a plurality of blocking pins 414 extending from the pedestal body 401 outside the basin wall 402. Each of the plurality of blocking pins 414 is retractable. In an extended position, the blocking pin 414 is taller than the basin wall 402 thus prevents a substrate supported on the liquid surface 416 from drifting away. In one embodiment, the plurality of blocking pins 414 are evenly distributed alone a perimeter of the basin wall 402. The blocking pins 414 may be pressed to retract during transferring of a substrate between a polishing head and the substrate holder 400, as shown in FIG. 7D.

The substrate holder 400 further comprises one or more aligning pin 415. As shown in FIG. 7B, the aligning pins 415 extend from the pedestal body 401 outside the basin wall 402. Each aligning pin 415 has a coned shape to form an extended circle around the basin wall 402. The aligning pins 415 are configured to gradually align with the substrate 418 during dropping off the substrate 418. The coned shape of the aligning pins 415 gradually guides the substrate 418 towards the basin wall 402 as the substrate 418 moves vertically downward. The aligning pins 415 may be pressed to retract during transferring of a substrate between a polishing head and the substrate holder 400, as shown in FIG. 7D.

The substrate holder 400 further comprises one or more head aligning pin 419. As shown in FIG. 7B, the head aligning pins 419 extend from the pedestal body 401 outside the basin wall 402. The head aligning pins 419 is configured to align the substrate holder 400 with the polishing head 450 when the polishing head 450 approaches the substrate holder 400, as shown in FIG. 7D.

Figure 7E:
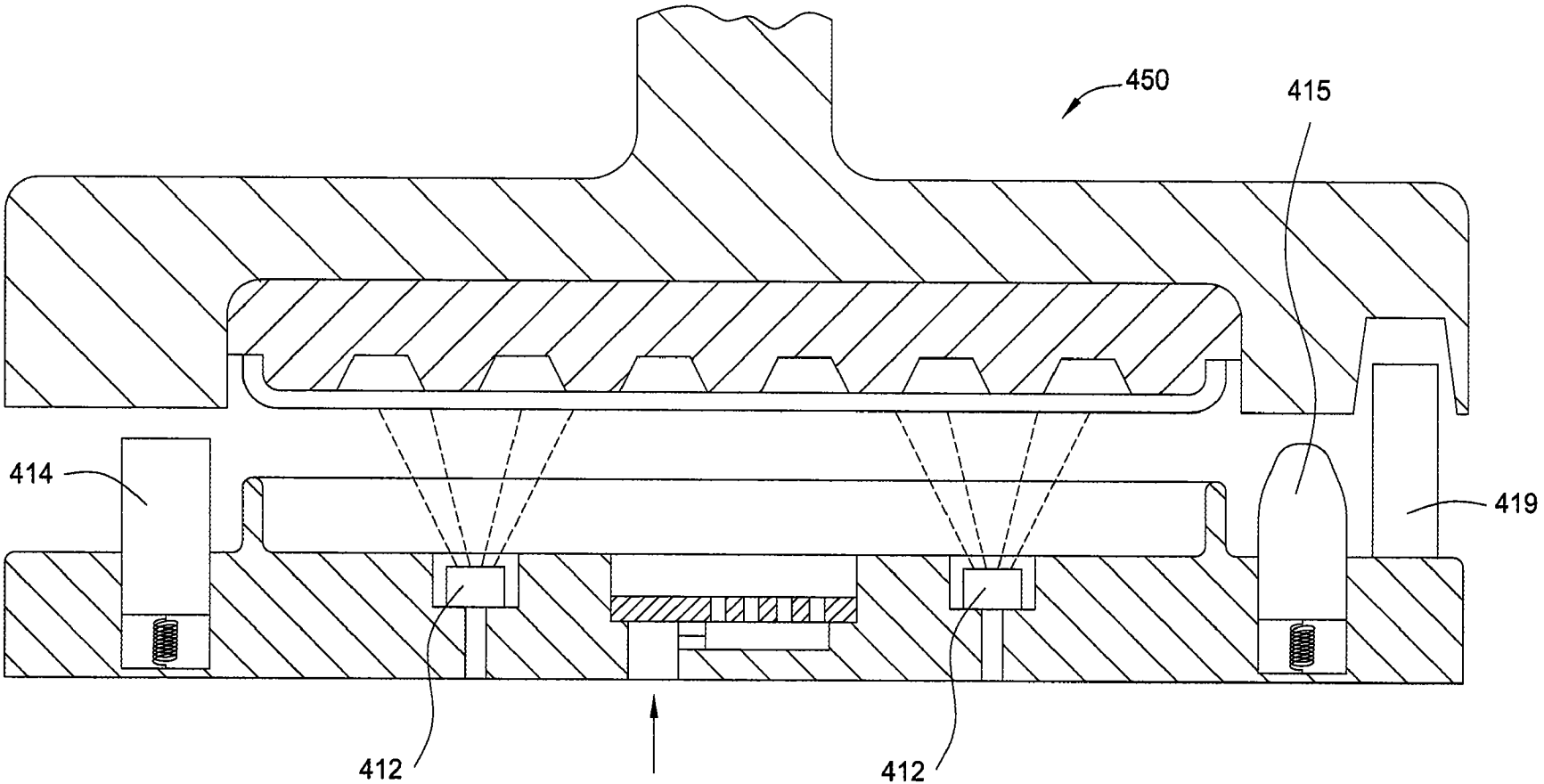

The substrate holder 400 further comprises a plurality of spraying nozzles 412 disposed in recesses 411 formed under the top surface 403 of the pedestal body 401 inside the basin 404. The spraying nozzles 412 are configured to spray cleaning solution to a polishing head as shown in FIG. 7E. The spraying nozzles 412 may also be used to clean substrates prior to or after loading. The spraying nozzles 412 are formed in the recesses 411 to avoid contact with the substrate.

The substrate holders of the present invention use a smooth liquid surface to support a substrate. As a result, very small impact is applied to the substrate from the liquid during operation, thus, reduces damages to delicate features formed on the substrate. The liquid contact of the substrate holders of the present invention reduces contacts between the substrate surface and the air, thus reducing erosion and contamination.

Even though a planarization process is described with the non-contact substrate holder of the present invention, a person skilled in the art can apply the non-contact substrate holder for holding and transferring substrates in any suitable processes, such as wet cleaning, electroplating, and electroless plating.

While the foregoing is directed to embodiments of the present invention, other and further embodiments of the invention may be devised without departing from the basic scope thereof, and the scope thereof is determined by the claims that follow.

What is claimed is:

1. A substrate holder, comprising:

a pedestal plate;

a basin wall extending from a top surface of the pedestal plate, wherein the basin wall has a substantially leveled top surface, the basin wall and the pedestal plate define a basin configured to retain a liquid therein;

a liquid port opening formed in the basin, wherein the liquid port is configured to flow the liquid to the basin and allow the liquid to overflow from the basin wall;

one or more alignment pins extending from the top surface of the pedestal plate outside the basin wall; and a liquid distributing plate disposed within a liquid pocket formed in the pedestal plate, wherein the liquid pocket is in fluid communication with a liquid source or a liquid drain, and the liquid distributing plate has a plurality of distributing holes formed therethrough to fluidly connect the basin to the liquid pocket.

2. The substrate holder of claim 1, further comprising one or more substrate guide pins extending from the top surface of the pedestal plate, wherein the one or more substrate guide pins are taller than the basin wall and are configured to keep the substrate supported on the liquid surface from drifting away.

3. The substrate holder of claim 2, wherein each of the one or more alignment pins has a tapered shape, and each of the of one or more substrate guide pins are substantially cylindrical.

4. The substrate holder of claim 1, further comprising one or more recesses formed in the pedestal plate, the one or more recesses having a cleaning nozzle disposed therein and configured to spray a cleaning solution upwards.

5. The substrate holder of claim 4, wherein the one or more recesses are formed under the top surface of the pedestal plate inside the basin wall.

6. A method for processing a substrate, comprising:

filling a bowl container in a first substrate holder with a liquid to form and maintain a flow of overflow liquid over the bowl container, wherein the flow of the overflow liquid provides a smooth liquid surface and allows a substrate to stay afloat on the smooth liquid surface;

releasing the substrate onto the flow of the overflow liquid without forming air bubbles between the smooth liquid surface of the overflow liquid and the substrate supported thereon; and picking up, using a second substrate holder, the substrate from the liquid surface by increasing the flow of the overflow liquid to release the substrate from the liquid surface.

7. The method of claim 6, further comprising:

cleaning a surface of the substrate by spraying a cleaning solution from a nozzle disposed within one or more recesses formed in the first substrate holder.

8. The method of claim 6, further comprising aligning the first and second substrate holders using one or more aligning pins extending from a top surface of the first substrate holder outside the bowl container.

9. A method for transferring a substrate, comprising:

maintaining a flow of a liquid to a basin of a load cup to form a liquid support surface for supporting a substrate and to allow the liquid overflow from walls of the basin without causing a turbulence in the liquid support surface;

aligning a first substrate handler with the load cup, wherein the substrate is secured by the first substrate handler;

releasing the substrate to the load cup, so that the substrate is supported by the liquid support surface;

aligning a second substrate handler with the load cup; and increasing the flow of the liquid to release the substrate from the load cup to the second substrate handler.

10. The method of claim 1, wherein the first substrate handler is a robot and the second substrate handler is a polishing head.

11. The method of claim 10, wherein releasing the substrate from the load cup to the second substrate handler comprises pushing the polishing head against the substrate to the liquid support surface and providing a constant flow of the liquid to counter a pressing force from the polishing head.

12. The method of claim 1, further comprising spraying a cleaning solution from the load cup to a surface of the substrate secured within the first or second substrate holder.

13. The method of claim 1, wherein aligning the first and second substrate holders comprise aligning the first and second substrate holders with one or more alignment pins disposed on the load cup outside the walls of the basin.

14. The method of claim 9, further comprising repeating the steps for each substrate to be transferred.

15. The substrate holder of claim 2, wherein the one or more guide pins are retractable and evenly disposed alone a perimeter of the pedestal plate in between the basin wall and the alignment pins.

* * * * *

UNITED STATES PATENT AND TRADEMARK OFFICE

CERTIFICATE OF CORRECTION

PATENT NO. : 8,021,211 B2
APPLICATION NO. : 12/105798
DATED : September 20, 2011
INVENTOR(S) : Chen et al.

It is certified that error appears in the above-identified patent and that said Letters Patent is hereby corrected as shown below:

Column 7, Claim 3, Line 55, please delete "of" after the.

Signed and Sealed this
Twenty-seventh Day of December, 2011

David J. Kappos

David J. Kappos
*Director of the United States Patent and Trademark Office*